US007152950B2

(12) United States Patent
Takekoshi et al.

(10) Patent No.: US 7,152,950 B2
(45) Date of Patent: Dec. 26, 2006

(54) METHOD FOR PRINTING AN IMAGE

(75) Inventors: Nobuhiko Takekoshi, Kanagawa (JP); Tetsuto Kageyama, Kanagawa (JP); Takeshi Irizawa, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 328 days.

(21) Appl. No.: 10/843,461

(22) Filed: May 12, 2004

(65) Prior Publication Data

US 2005/0007416 A1 Jan. 13, 2005

(30) Foreign Application Priority Data

May 16, 2003 (JP) ..... 2003-139603

(51) Int. Cl.
*B41J 2/21* (2006.01)

(52) U.S. Cl. ..... 347/43

(58) Field of Classification Search ..... None
See application file for complete search history.

(56) References Cited

U.S. PATENT DOCUMENTS

| | | | | |
|---|---|---|---|---|
| 4,748,453 | A | 5/1988 | Lin et al. | |
| 5,252,992 | A | 10/1993 | Fukushima et al. | |
| 5,594,478 | A | 1/1997 | Matsubara et al. | |
| 5,604,520 | A | 2/1997 | Matsubara et al. | |
| 5,633,663 | A | 5/1997 | Matsubara et al. | |
| 5,696,542 | A | 12/1997 | Matsubara et al. | |
| 5,831,642 | A | 11/1998 | Matsubara et al. | |
| 6,130,685 | A | 10/2000 | Matsubara et al. | |
| 6,250,737 | B1 | 6/2001 | Matsubara et al. | |
| 6,601,939 | B1 | 8/2003 | Fujita et al. | |
| 6,877,850 | B1 * | 4/2005 | Ishimoto et al. | 347/100 |
| 2002/0024558 | A1 | 2/2002 | Fujita et al. | |
| 2002/0167565 | A1 | 11/2002 | Maeda et al. | |
| 2002/0175983 | A1 | 11/2002 | Ishikawa et al. | |
| 2005/0157067 | A1 * | 7/2005 | Hoshino | 347/43 |

FOREIGN PATENT DOCUMENTS

| | | |
|---|---|---|
| JP | 55-113573 | 9/1980 |
| JP | 58-194541 | 11/1983 |
| JP | 6-228476 | 8/1994 |
| JP | 7-247452 | 9/1995 |
| JP | 7-268261 | 10/1995 |
| JP | 3093489 | 10/2000 |
| JP | 3200143 | 8/2001 |
| JP | 3236034 | 12/2001 |
| JP | 3249878 | 1/2002 |
| JP | 2002-69340 | 3/2002 |
| JP | 2002-144552 | 5/2002 |
| JP | 2002-292910 | 10/2002 |

* cited by examiner

*Primary Examiner*—Thinh Nguyen
(74) *Attorney, Agent, or Firm*—Fitzpatrick, Cella, Harper & Scinto

(57) ABSTRACT

In one printing scan of a plurality of printing scans of a multi-scan system, in which an ink dominant on the surface of a printing medium is set, the printing percentage of the ink relatively low in the degree of glossiness is set to be higher than that of the ink relatively high in the degree of glossiness. Thereby, the ink relatively low in the degree of glossiness becomes dominant in an overall image, so that the degree of glossiness is stabilized at a low level, even if the bi-directional printing operation is carried out, or the printing duty varies. Thus, the glossy-banding hardly occurs.

12 Claims, 9 Drawing Sheets

METHOD FOR PRINTING AN IMAGE

This application claims priority from Japanese Patent Application No 2003-139603 filed May 16, 2003, which is incorporated hereinto by reference.

BACKGROUND OF THE INVENTION

1. Field of the Invention

The present invention relates to a method for printing an image by using an ink jet printing apparatus for ejecting ink from a printing head to a printing medium, particularly to a method for printing an image by a serial type ink jet printing apparatus while adopting a multi-scan system.

2. Description of the Related Art

There are various image-forming apparatuses for forming image information (including characters, symbols or others), such as those having a printing function, a copying function or a facsimile function, those integral with a computer or a word processor, or those used as output devices for a work station. In such image-printing apparatuses, the printing operation is carried out on a printing medium such as paper or a plastic sheet (a transparency film), based on the image information by using printing means of a predetermined system. As representatives of such a printing system applied to this printing means, for example, an ink jet system, a wire dot system, a heat-sensitive system, a thermal transfer system and an electro-photographic system are listed.

Of them, the ink jet system operates to eject ink from the printing head, which is printing means, to the printing medium to form the image thereon. According to this system, it is possible to print a high-precision image at a high speed while making the printing head more compact than those in the other systems. Also, by carrying a plurality of color ink heads simultaneously thereon, it is possible to relatively easily realize colorization. Further, since the printing is done directly on a plain paper, the running cost is low, and since this system is a non-impact system, noise is less. In view of such merits, the printing apparatus of the ink jet system has recently been widely used in personal users.

The ink jet system is classified into several types in accordance with means for generating energy used for ejecting ink. Of them, a thermal ink jet system is most popular. In the thermal ink jet system, an electro-thermal converter; i.e., a so-called heater; is disposed in an ink passage of the respective printing element (hereinafter also referred to as a nozzle). A bubble is generated in the ink passage by the application of voltage to the heater, and used as the energy for ejecting ink. According to the printing head of this system, during the production process, steps for producing a semiconductor are carried out, such as an etching, a deposition or a sputtering, to provide electro-thermal converters or electrodes by films on a substrate and form liquid passage walls and top walls thereon. Thereby, it is possible to arrange ink passages at a relatively high density. Also, by using the advantages of an IC technology or a micro-processing technology, it is possible to realize the prolongation or the planarization of the printing head. Accordingly, the thermal ink jet system is advantageous in that it is responsible even to the recent requirement for a high-speed and high-resolutional printed image by the adaptation of the structure of the printing head.

The ink jet printing apparatus is classified into a line type and a serial type in accordance with the printing style thereof. The serial type mainly prevails among personal users because of its small size and low cost. The serial type printing apparatus sequentially forms the image on the printing medium by alternately repeating a main printing scan for moving a carriage mounting the printing head thereon relative to the printing medium while ejecting ink from the printing head and a sub-scan for conveying the printing medium by a predetermined amount in the direction orthogonal to the main printing scan, in this case, a width of an area in which the image is to be printed by one main printing scan is determined in accordance with the arrangement density and a number of a plurality of ink ejection orifices provided in the printing head. Accordingly, if the printing operation is proceeded by repeating the main printing scan for covering that width and the sub-scan in correspondence to that width, the image will be completed in the shortest time. Practically, however, a so-called multi-scan system is often adopted for the purpose of further improving the image quality.

The explanation will be briefly made on the multi-scan system below. In the multi-scan system, the main printing scan is executed N times ($N \geqq 2$) in the area which would be printed by one main printing scan. An amount of the sub-scan carried out between the subsequent main printing scans corresponds to a printing width of a plurality of printing elements contained in each block when the number of printing elements arranged in the printing head is divided into N blocks. That is, the image in the same image area is formed by the printing elements contained in N blocks through N printing scans.

In general, the number of printing elements contained in the respective block is the same when divided into N blocks. This, however, is not limitative. For example, when a total number of the printing elements cannot be divided by N, each of the blocks Nos.1 to N−1 may be composed of M elements (M is an optional number) and the final block No. N may be composed of the residual number of elements. Alternatively, by sequentially repeating M elements and N elements (M and N are optional numbers, respectively), the printing width in the going direction (the direction of the odd number scan) and that in the returning direction (the direction of the even number) may be equalized to each other. Further, for example, the printing head having ten printing elements may be divided into three blocks of two, six and two printing elements, wherein the areas, each printed by the two printing elements located at the respective ends, are solely subjected to twice the printing scans of the multi-scan system. In this case, the area printed by the six printing elements located in a central region is completed by a single printing scan, whereby the multi-scan number may be represented by N =1.5 times.

Since the image is completed by a plurality of printing scans executed by different blocks according to the multi-scan system, all of the printable image data are not printed by one main printing scan. Thus, a mask is used for distributing image data to the respective blocks. The mask is often determined independently from the image signal. For example, it is possible to form the construction for determining whether or not the image signal given by the respective printing scan is to be printed.

At this time, as seen from the individual image data, a probability to be printed by one main printing scan is determined by this mask. In other words, the image data to be printed are thinned to a certain extent by the mask, wherein the thinning probability is referred to as a thinning percentage in this text. The thinning percentage is meant in reverse to a probability for printing the data during the respective printing scan (hereinafter referred to as a printing percentage).

One concrete example of the multi-scan system in accordance with the above structure will be cited below. When the multi-scan printing is carried out four times while using a hundred printing elements, the printing elements are divided into four blocks, each consisting of 25 printing elements. An amount of the sub-scan between the subsequent printing scans corresponds to 25 printing elements. The mask corresponding to the respective block in the respective printing scan has the thinning percentage of 75% and the printing percentage of 25%. The mast patterns are complemental each other between the four blocks, and by overlaying the four mask patterns with each other, the 100% printing is carried out In this regard, although the description has been made, as a general example, so that one hundred printing elements are evenly divided by the multi-scan number N=4, the multi-scan system should not, of course, be limited thereto. As described before, the multi-scan number N may not completely divide the total number of the printing elements. If the main printing scan is carried out by a plurality of different blocks, the multi-scan system is realized.

The technology disclosing the basic structure and effect of the above-mentioned multi-scan system will be introduced below.

Japanese Patent Application Laid-open No. 55-113573 (1980) discloses a structure for complete the image by two printing scans of going and returning passages. The mask pattern applied to the respective printing scan is limited to an alternate lattice-like checker pattern both in the vertical and horizontal directions, and the adjacent dots are not printed by the same printing scan. A dot printed by the second printing scan is applied before a dot which has been printed by the first printing scan completely dries to prevent the dot from deforming. In this case, the thinning percentage of the respective main printing scan is limited to 50% by the checker pattern, and there is no description about the conveying amount in the sub-scanning direction. Accordingly, the effect for smoothing the overall image as in the above-mentioned multi-scan system is not disclosed in this document.

Japanese Patent Application Laid-open No. 58-194541 (1983) discloses a method for preventing the color-banding during the bi-directional printing in the serial type color printer. In this method, a printing head having a plurality of rows of printing elements arranged parallel to each other is used for carrying out the reciprocation printing scan. At this time, dots less than total dots to be printed are intermittently printed in the going passage, while the residual dots are intermittently printed in the returning passage. Thereby, it is possible to arrange the dots, each different in the overlaying order from the other, to be uniformly distributed in an area by the overlaid printing of the plurality of rows of the printing elements. Accordingly, it is possible to prevent the deviation of the color tone in the printed image mainly derived from the overlaying of color inks. In this case, the main purpose is to avoid the color-banding, and there is no description about positions of dots to be printed by the respective printing scans. In the disclosed embodiment, mask patterns other than the checker pattern are described, such as a transverse thinning pattern for alternately printing solely in the vertical direction or a vertical thinning pattern for repeating the thinning printing solely in the transverse direction.

The U.S. Pat. No. 4,748,453 discloses a printing method carried out on a printing medium having a low ink-absorption rate such as an OHP sheet (transparency film) When the printing is carried out on the same area by first and second (or more) printing scans, pixels located alternately in the horizontal and vertical directions are solely printed in the same printing scan, and then the complemental printing is carried out in the subsequent printing scan so that is the beading of ink is avoided on the printing medium having a low ink-absorption rate. Also, if a color image is formed, in the same manner as in the above-mentioned Japanese Patent Application Laid-open No. 58-194541 (1983), the order of the ink ejection to mixed color pixels is reversed between the first and second printing scans (in other words, the reciprocation printing is carried out), whereby there is also an effect for avoiding the color-banding. Since a main object of the U.S. Pat. No. 4,748,453 resides in the avoidance of the beading between the respective pixels, the pixels printed by one scan are alternately arranged both in the horizontal and vertical directions (that is, pixels are not adjacent to each other).

A feature common to these three patent documents described above is that the same image area is completed by a plurality of printing scans, which could be said as the basic feature of the multi-scan system. However, in either case, it is adapted that the adjacent dots are not simultaneously formed or the dots to be printed are distributed as far and uniformly as possible between the respective printing scans. As a mask pattern, a checker pattern or a simple vertical or transverse thinning pattern is used common to the respective colors.

By adopting the multi-scan system described above, it is possible to obtain, not only the effects disclosed in the three patent documents, but also other effects in that the variation of the printed positions due to the printing elements or that of the amounts of the sub-scan is spread to smooth the image as a whole by conveying the printing medium at a predetermined amount between the main printing scans. Particularly, an effect for eliminating a so-called joint streak generated on the boundary between the adjacent printing scans is important, whereby the multi-scan system has been widely used at present in the serial type ink jet printing apparatus.

In this regard, if the printing percentage of the mask pattern and the amount of the sub-scan are reduced and conversely the number of multi-scans is increased, the conventional multi-scan system is further effective. That is, a smoother image is obtainable from four scans than two scans, or from eight scans than four scans. On the other hand, however, the increase in the number of multi-scans results in the increase in the number of printing scans and, therefore, the prolongation of the printing time. Accordingly, in the recent time, a structure is put into practice, in which a plurality of printing modes are provided in advance in the printing apparatus so that the user is selected a suitable one therefrom in accordance with kinds and/or uses of the printed image.

Further, according to the multi-scan system, it is possible to solve more problems and generate new effects by changing the mask pattern and the amount of the sub-scan while regulating the mutual relationship between the both. Conversely, there may be a case in which new problems arise by adopting the multi-scan system. Accordingly, many multi-scanning methods are recently proposed, using masks having various characteristics in accordance with the problems or objects to be solved.

Several prior arts which are the modification of the multi-scan system will be described below. In the serial type printing apparatus, there are a mono-directional printing in which the printing is carried out solely in the going printing scanning direction and a bi-directional printing in which the printing is alternately carried out both in the going and returning scanning directions. Of course, the bi-directional printing is more advantageous in view of the time cost than the other because the printing time is shortened by the backward scanning. In this case, however, a new problem called as color-banding generates in the color ink jet printing apparatus.

The color-banding is a problem generated due to the difference in order of ink colors to be printed in accordance with the directions of the printing scan. That is, even if the printing is carried out based on the same data, there is a difference in tint visible by naked eyes between images printed in the going passage and the returning passage.

Several countermeasures characterized by a mask have already been proposed for solving such color-banding. For example, according to Japanese Patent No. 3,200,143, a method for reducing the color difference between the going printing scan and the returning printing scan is disclosed, by carrying out the printing with different colors at different positions in the same printing scan, while using a mask characterized in that, in a plurality of thinning masks corresponding to different colors, the arrangement of pixels in at least one mask is different from that in the other thinning masks.

Also, according to Japanese Patent No. 3,236,034, there is the disclosure in that mask patterns are provided in fixed correspondence to a plurality of blocks, respectively, so that the mutually complemental relationship is maintained between the blocks, which relationship is the same both in first and second printing heads. According to this document, it is possible to mitigate the color-banding due to the deviation of the printing percentage in the respective printing scan caused by the relationship of the arrangement between the mask pattern and the image data, by fixing the mask pattern to the printing head.

Further, Japanese Patent Application Laid-open No. 2002-144552 discloses a structure of a mask pattern in the multi-scan system of three scans or more for approximately equalizing areas covered with initial two scans (a covered amount), based on a fact that a dominant color is mainly decided in the initial two scans. The above-cited Japanese Patent Application Laid-open No. 2002-144552 supposes that the color image is printed mainly with ink excellent in permeability, and is characterized in that the printing percentage in the first scan is made to be lower than that in the second scan to approximately equalize the cover amounts by the two scans.

In the above description, the prior arts for mainly solving the color-banding have been cited. However, for example, in Japanese Patent No. 3,093,489, the multi-scan method for positively solving the joint streak in addition to the color-banding is disclosed. In Japanese Patent No. 3,093,489, there is a description in that an image is completed in an image area by sequentially printing the thinned images having a predetermined printing ratio by the respective main scans, and in at least one of a plurality of main scans, the printing ratio to a pixel group in the boundary region between the adjacent image areas is made to be smaller than the predetermined printing ratio. This is because the joint streak is liable to occur in the boundary region since one more printing scan is repeated in this region than the other region, and therefore, the mask pattern is adapted to complete the image even in the boundary region by the same number of the printing scans as in the other regions, if possible.

Further, according to Japanese Patent Application Laid-open No. 2002-292910, a mask pattern for mitigating a drawback called as an end deflection is disclosed, which is peculiar to a case wherein ink droplets are ejected at a high speed and a high density. According to Japanese Patent Application Laid-open No. 2002-292910, since one cause of the end deflection is the high-density ejection of ink in an end region of the printing head, the printing percentage of the mask pattern to be applied to the end region of the printing head is to be lower than in the other region.

As described above, suitable mask patterns and multi-scanning methods are employed for solving various problems in the recent ink jet printing apparatus so that a high-quality image is obtainable.

In the conventional color ink jet printing apparatus, ink mainly composed of dyestuff and excellent in permeability has generally been used. In the color printing, it is important that different color inks are quickly absorbed in the printing medium without blotting each other on the printing medium. If the different color inks are brought into contact with each other prior to being absorbed in the printing medium, the mixing of the inks occurs to cause a defect called as a boundary blotting on the image.

Although the ink excellent in permeability has a drawback in that a printed dot becomes unnecessarily larger and a sufficient color density is difficult to be resulted, as well as this ink is inferior in clarity in comparison with ink low in permeability to be characteristic of subsequently overlaying the printed ink (hereinafter referred to as an overlay type ink in this text), Nonetheless the ink excellent in permeability has been often used in the prior art for avoiding the occurrence of the boundary blotting.

Recently, since a high-precision printing head has been developed, an amount of ink ejected from one printing element becomes very little. Accordingly, the boundary blotting on the printing medium has gradually become less problematic, and the situation for using the overlay type ink in the color printing has being established. In addition, since a new printing medium has been developed to realize the clearer printing free from the boundary blotting, the advantage of the color ink jet printing apparatus is capable of ejecting a small droplet of the overlay type ink is recently recognized again.

In the overlay type ink, not only dyestuff but also pigment is usable as a colorant. If the pigment is used, it is expected that various properties necessary for the printed image are enhanced, such as color density and clarity of the printed image, the image-reserving capacity such as water-resistance or light-resistance, whereby the value of the ink jet printing apparatus itself is up-graded.

However, the ink using pigment or the overlay type ink have problems peculiar thereto. One of them is a so-called bronzing. The bronzing is a phenomenon in that the printed image varies its tint or glossiness as a bronze product in accordance with the light-projecting direction or the image-viewing direction. To solve this bronzing, a method for producing the ink itself has already been improved. For example, see Japanese Patent Application Laid-open Nos. 7-247452 (1995), 6-228476 (1994), 7-268261 (1995) and 2002-069340, and Japanese Patent No. 3,249,878.

In practice, however, there is hardly a case in which the ink completely free from the bronzing as disclosed in the above prior art documents is solely used. This is because a limit exists in the application range of the ink due to various factors such as the ink-ejection characteristic of the printing head, the compatibility of the ink with a printing medium or the production cost of the ink.

Even though the ink is improved by the above-mentioned various methods for the production of ink, the effect thereof is insufficient for solving the problem relating to the ink glossiness in the recent color ink jet printing apparatus of a multi-scan system.

In the color ink jet printing apparatus using a plurality of color inks, the glossiness of the image is differently felt in accordance with ink color. It is also known that the glossiness varies by an amount of ink ejected to the printing medium (an application amount) and the degree of variation thereof is different in accordance with ink colors.

FIG. 1 shows the degree of glossiness of a plurality of color pigment inks, which is a physical value felt as the glossiness, measured while varying the ink-ejection amount. In FIG. 1, the abscissa axis represents the ink-ejection amount per unit area in the printing medium and the ordinate axis represents the degree of glossiness of the printing medium in the respective ink colors in correspondence to the respective ink-ejection amount. In this regard, the measurement was carried out by using a Gloss Checker IG-320 manufactured by K.K. Horiba Seisakusho. The calibration during the measurement is carried out by measuring a reference plate having the degree of glossiness of 90 determined in comparison with a surface of a glass plate standardized by JIS having a refractive index of 1.567 which degree of glossiness is defined as 100, while slanting the Gloss Checker at 60° together with a light source relative to a vertical line.

It is apparent that the difference exists in degree of glossiness between ink colors from results of the measurement shown in FIG. 1. It is also confirmed that, while the degree of glossiness becomes basically larger as the ink-ejection amount increases, the rising rate or changing rate thereof is different between the respective ink colors.

One of reasons for generating the difference in degree of glossiness in accordance with the ink colors is that the glossiness is relied on the aggregation of the colorant such as dyestuff or pigment and the degree thereof is different in accordance with molecular structures of the colorant. Further, the aggregation is accelerated by the contact of adjacent dots before the ejected ink is absorbed by the printing medium. Accordingly, the pigment type ink having a relatively low permeation speed is felt to have a higher degree of glossiness than the dyestuff type ink having a higher permeation speed. In addition, since the pigment type ink is liable to be influenced with the contact between adjacent ink dots as described above, the degree of glossiness is easily variable in accordance with the ink-ejection amount.

Reasons why the pigment type ink is low in permeability In comparison with the dyestuff type ink are as follows. One is that since the pigment type ink contains more resin component or oil component than in the dyestuff type ink, the viscosity or surface tension is relatively high. If the ink viscosity or surface tension is high, the permeation speed into the printing medium is also low. Even if the viscosity of the pigment type ink is made to be equalized to that of the dyestuff ink, the surface tension may increase. Further, the pigment particle has a relatively large diameter in comparison with the dyestuff particle. Even in the general aqueous pigment type ink, the particle diameter thereof reaches approximately 100 nm, whereby the permeation speed or fixing speed into the printing medium is lower than that of the dyestuff type ink.

In general, ink having the low permeation speed such as the pigment type ink is used as the overlay type ink. When the printing is carried out by the bi-directional multi-scan system while using the overlay type ink, the following problem may occur.

When the overlay type ink is used, lately printed ink is overlaid with earlier printed ink, and therefore, the image surface is dominated by the tint or glossiness of the lately printed ink. For this reason, in this text, the color of ink located at the uppermost surface is referred to as a dominant color.

Under such a condition, it is supposed that a uniform green image is printed with cyan ink having a relatively high degree of glossiness and yellow ink having a relatively low degree of glossiness by using a serial type ink jet printing apparatus. In this case, if the ink is applied in the order of cyan and yellow in the going direction, the ink is applied in the reverse order, that is, yellow and cyan, in the returning direction. Accordingly, an area printed in the going direction is dominated by yellow, and another area printed in the returning direction is dominated by cyan When the multi-scan system is adopted, the dominant color is decided by the direction of the final printing scan. Therefore, the area in which the final printing scan is carried out in the going direction, yellow becomes the dominant color, while cyan becomes the dominant color in the area adjacent thereto As a result, the area in which yellow is the dominant color and the area in which cyan is the dominant color alternately appear on the image, whereby, in the visual sense, there is a problem in that areas having a high degree of glossiness and a low degree of glossiness appear as streaks to be felt as the glossy-banding. This phenomenon is a serious drawback of an image expected to have a high image quality.

The above-mentioned phenomenon in which areas having different dominant colors are alternately arranged simultaneously generates the color-banding. Accordingly, it is possible to use the technique already described in the prior art, such as Japanese Patent Nos. 3,200,143 or 3,236,034. According to the above patent documents, it is possible to approximately equalize a ratio of the dominant color in the respective image area as a pixel unit. That is, even if either yellow or cyan is a dominant color, the color-banding is reduced when the ratio of the dominant color is maintained approximately constant between the adjacent image areas.

SUMMARY OF THE INVENTION

In the glossy-banding, if the ratio of the dominant color is maintained constant as described above, the problem may be mitigated to some extent. However, it has been found by the diligent study of the present inventors that even if the ratio of the dominant color is maintained approximately constant in the respective image area, there is a great difference in the glossy-banding when the main dominant color is a certain color. Concretely, when yellow is the dominant color in all of the image areas, almost of the glossy-banding was eliminated, but when cyan is the dominant color, the glossy-banding still remained. Accordingly, when the technique disclosed in Japanese Patent Nos. 3,200,143 or 3,236,034 is applied, the color-banding may be solved but the glossy-banding is not completely solved thereby.

One cause of the glossy-banding not solved in this way is that the difference in degree of glossiness of cyan is large between the respective ink-ejection amounts. With reference again to FIG. 1, the degree of glossiness of cyan largely varies as the ink-ejection amount increases. Contrarily, regarding yellow ink, the degree of glossiness is not so seriously influenced by the ink-ejection amount, but maintained at a relatively low level. Thereby, when cyan is the dominant color, the large variation of color gradation causes the change in the degree of glossiness, which results in the glossy-banding. On the contrary, since the degree of glossiness has no large difference between the respective areas when yellow is the dominant color, it is difficult to recognize the glossy-banding. Such a phenomenon is a glossy-banding caused by the variation in the ink-ejection amount, and thus, the problem remains even if the mono-directional printing of the multi-scan system is adopted instead of the bi-directional printing.

In this regard, although such a phenomenon occurs when the printing is carried out with cyan ink only, the visual detection thereof as the actual glossy-banding is in a case wherein an image is formed with secondary or tertiary ink having a relatively large ink-ejection amount. Accordingly, an object of the present invention is to reduce the glossy-banding of the image formed with the secondary color or more, or 200% or more, from which is removed the glossy-banding in accordance with the mono-color ink-ejection amount.

In view of the above, the present inventors has found that, when a plurality of inks having different degrees of glossiness (that is, the degree of glossiness in correspondence to the ink-ejection amounts) are used, it is possible to control the dominant color on the printing medium by using mask patterns suitable for the degree of glossiness of the respective inks, and this method is effective for eliminating the glossy-banding. Contrarily, in the prior art, while there is a structure for using different mask patterns in correspondence to ink colors, the mask pattern suitable for the degree of glossiness of the respective ink has not been considered. As a result, the glossy-banding has not yet been solved.

The present invention has been made to solve the above-mentioned problems, and an object thereof is to eliminate the glossy-banding generated when the multi-scan system is adopted as much as possible in the color ink jet printing apparatus of a serial type.

In a first aspect of the present invention, there is provided A method for printing an image on a printing medium by ejecting ink from a plurality of printing heads for different inks, the method comprising the steps of: main printing scan step for scanning the printing heads with respect to the printing medium in a predetermined direction while printing the image on the printing medium, the main printing scan being repeated a plurality of times in the same area of the printing medium to complete the image; sub-scan step for relatively moving the printing medium and the printing heads in a direction different from the predetermined direction between the main printing scans, wherein a printing percentage of one ink having a relatively low degree of glossiness is higher than that of other inks having a relatively high degree of glossiness in one of the plurality of main printing scans in which the dominant color on the surface of the printing medium is defined.

In a second aspect of the present invention, there is provided A method for printing an image on a printing medium by using a plurality of printing heads for printing different liquids, wherein the printing of a liquid relatively low in glossiness is carried out later than the other liquids.

In a third aspect of the present invention, there is provided A method for printing an image by carrying out a printing scan in which a plurality of printing heads for ejecting a plurality of pigment inks there from move in a predetermined direction while ejecting the inks toward a printing medium alternately with a conveying motion in which the printing medium moves in the direction different from that of the printing scan; the printing scan of the printing heads being repeated a plurality of times in the same area of the printing medium to complete the image, wherein the plurality of pigment inks are different in degree of glossiness from each other when a predetermined amount thereof is applied to a unit area, and in the final printing scan in the plurality of recording scans in the same area, the printing percentage of the ink relatively low in the degree of glossiness is set to be higher than that of the ink relatively high in the degree of glossiness.

In a forth aspect of the present invention, there is provided A method for printing an image by carrying out a printing scan in which a plurality of printing heads for ejecting a plurality of inks there from move in a predetermined direction while ejecting the inks toward a printing medium alternately with a conveying motion in which the printing medium moves in the direction different from that of the printing scan; the printing scan of the printing heads being repeated a plurality of times in the same area of the printing medium to complete the image, wherein the plurality of inks are different in degree of glossiness from each other when a predetermined amount thereof is applied to a unit area, and have a nature in that, when the earlier printed ink is overlaid with the later printed ink on the printing medium, a ratio of a surface layer formed by the later printed ink is larger than that of a surface layer formed by the earlier printed ink, and in the final printing scan in the plurality of printing scans in the same area, the printing percentage of the ink relatively low in the degree of glossiness is set to be higher than that of the ink relatively high in the degree of glossiness.

In a fifth aspect of the present invention, there is provided A method for printing an image by carrying out a printing scan in which a plurality of printing heads for ejecting a plurality of pigment inks different in the degree of glossiness from each other move in a predetermined direction while ejecting the inks toward a printing medium alternately with a conveying motion in which the printing medium moves in the direction different from that of the printing scan; the printing scan of the printing heads being repeated a plurality of times in the same area of the printing medium to complete the image, wherein the plurality of pigment inks are different in the variation amount of the degree of glossiness with respect to the variation of the ink amount applied to the same area of the printing medium, and in the final printing scan of the plurality of printing scans in the same area, the printing percentage of the ink relatively low in the variation amount of the degree of glossiness is set to be higher than that of the ink relatively high in the variation amount of the degree of glossiness.

In a sixth aspect of the present invention, there is provided A method for printing an image by carrying out a printing scan in which a plurality of printing heads for ejecting a plurality of inks there from move in a predetermined direction while ejecting the inks toward a printing medium alternately with a conveying motion in which the printing medium moves in the direction different from that of the printing scan; the printing scan of the printing heads being repeated a plurality of times in the same area of the printing medium to complete the image, wherein the plurality of inks are different in the variation amount of the degree of glossiness with respect to the variation of the ink-ejection amount in a unit area, and have a nature in that, when the earlier printed ink is overlaid with the later printed ink on the printing medium, a ratio of a surface layer formed by the later printed ink is larger than that of a surface layer formed by the earlier printed ink, and in the final printing scan of the plurality of printing scans in the same area, the printing percentage of the ink relatively low in the variation amount of the degree of glossiness is set to be higher than that of the ink relatively high in the variation amount of the degree of glossiness.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The preferred embodiments of the present invention is will be described in detail below. In this text, a term "a plurality of kinds of color ink different in degree of glossiness" refers to inks having different degrees of glossiness when the same amount of ink is ejected to a unit area. Hereinafter, ink exhibiting a relatively high degree of glossiness when the same amount of the ink is ejected to a unit area is referred to as "ink having (relatively or comparatively) high degree of glossiness", and ink exhibiting a relatively low degree of glossiness is referred to as "ink having (relatively or comparatively) low degree of glossiness". For example, as apparent from FIG. 1, in a case of cyan and yellow, since the degree of glossiness of cyan corresponding to the ink ejection amount of 100% is higher than the degree of glossiness of yellow corresponding to the ink ejection amount of 100%, the cyan ink is the ink having (relatively or comparatively) high degree of glossiness, while the yellow ink is the ink having (relatively or comparatively) low degree of glossiness.

Figure 1:
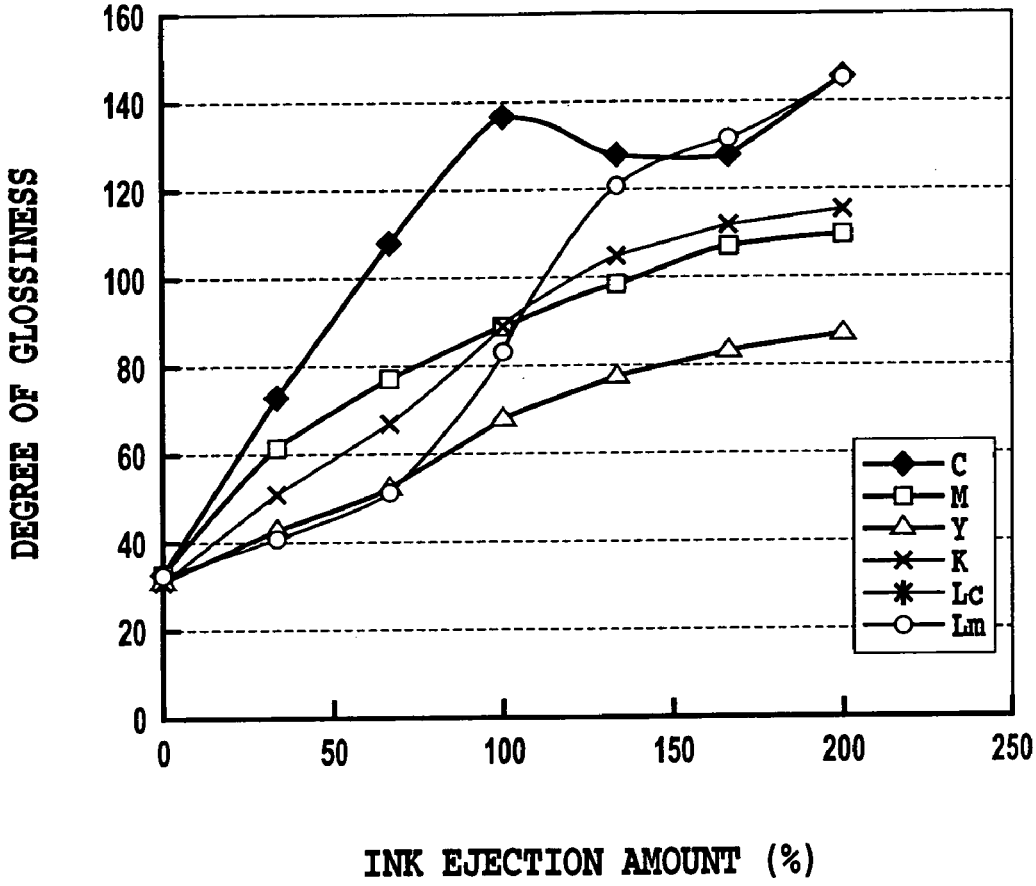
FIG. 1 is one example of the degree of glossiness relative to the ink-ejection amounts of color inks usable for the present invention.

In this text, "the variation amount of the degree of glossiness is different in accordance with the variation of the ink-ejection amount to a unit area" means that, when the ink-ejection amount is changed within a predetermined range (for example, from 0 to 100%), the variation amount of the degree of glossiness is different in correspondence to the ink-ejection amount. With reference to FIG. 1, since the degree of glossiness varies from 30 to 135 when the ink-ejection amount of cyan ink is changed within a predetermined range (for example, from 0 to 100%), the variation amount thereof is 95, while since the degree of glossiness varies from 30 to 65 when the ink-ejection amount of yellow ink is changed within a predetermined range (for example, from 0 to 100% ), the variation amount thereof is 35. Accordingly, the variation amount of the degree of glossiness is different between the cyan ink and the yellow ink in accordance with the variation of the ink-ejection amount to a unit area.

Figure 2:
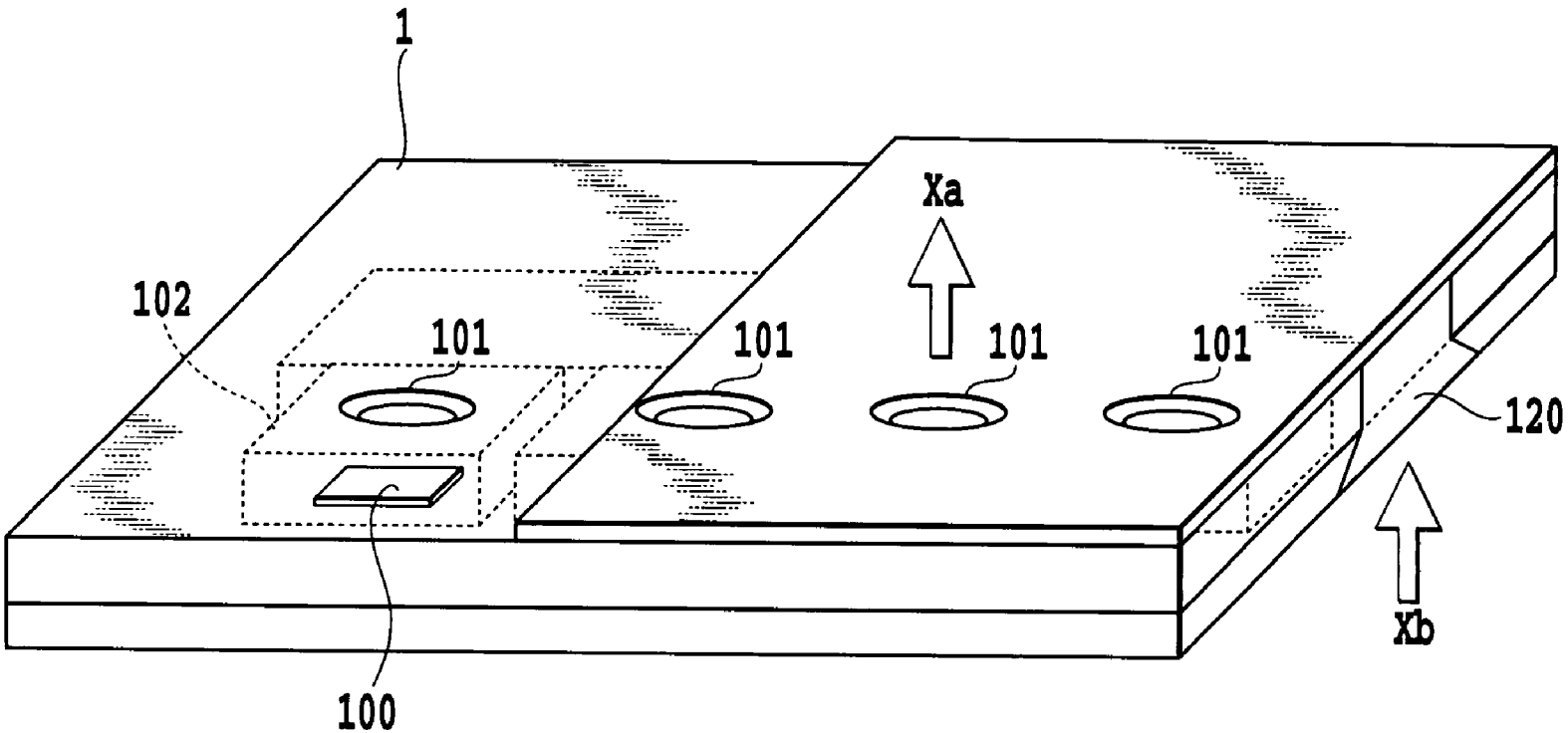
FIG. 2 illustrates a structure of an ink jet printing head usable for the present invention.

FIG. 2 illustrates a structure of an ink jet printing head usable for the present invention. In FIG. 2, ink fed to a printing head 1 in the direction indicated by an arrow Xb fills a plurality of nozzles 102 via a common liquid chamber 120. The respective nozzle 102 is provided with an electro-thermal converter 100 and an orifice 101 disposed opposite thereto, wherein the plurality of orifices 101 are arranged at a predetermined pitch in the same plane of the printing head 1. The respective electro-thermal converter 100 has a wiring, through which a pulse voltage corresponding to a printing signal is applied to the electro-thermal converter 100. Thus, the electro-thermal converter 100 is heated to generate bubbles in the ink filled in the nozzle 102. Due to the energy of the bubbles thus generated, the ink in the nozzle 102 is ejected from the orifice 101 in the direction indicated by an arrow Xa.

Figure 3:
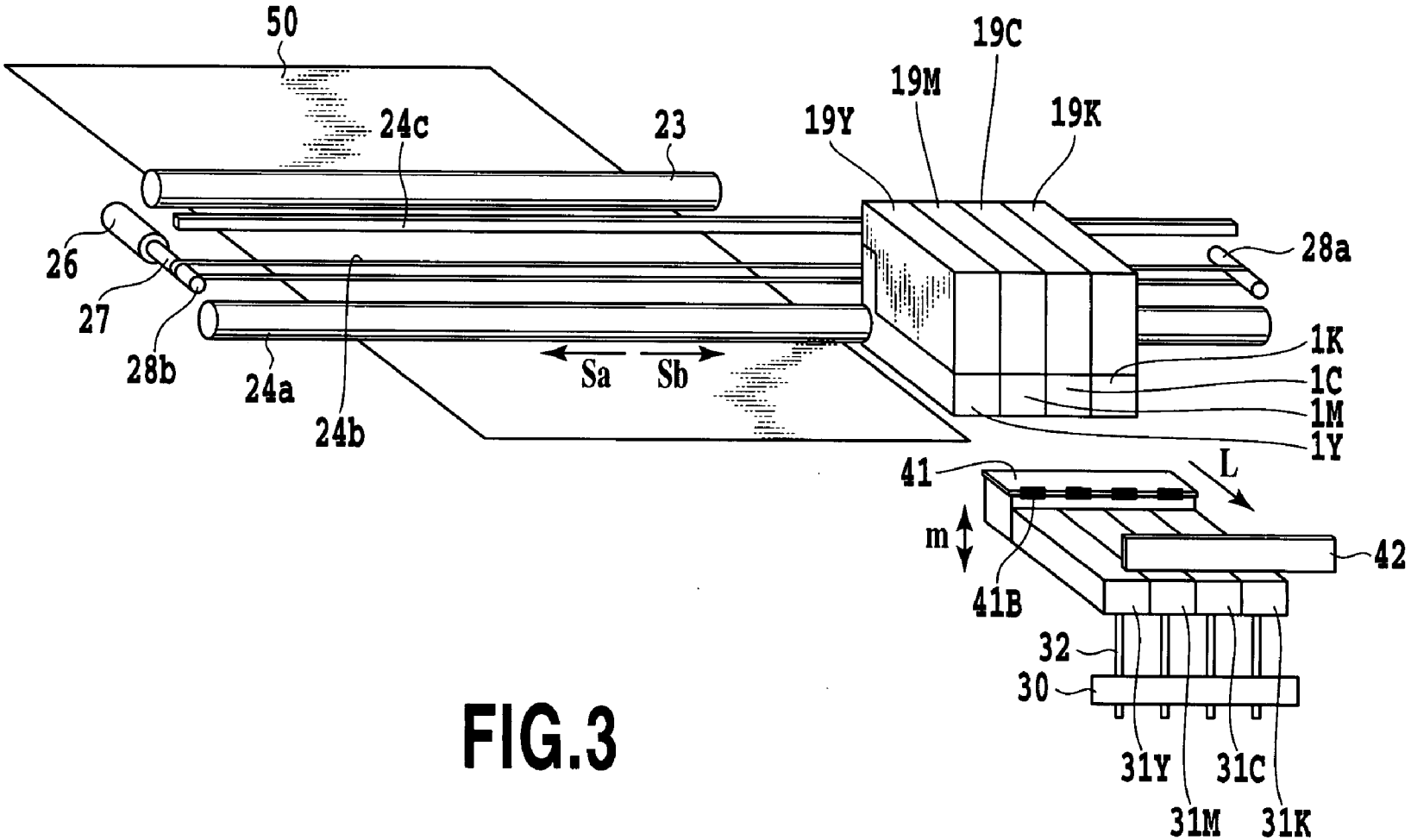
FIG. 3 is a schematic view illustrating the interior structure of an ink jet printing apparatus used in one embodiment of the present invention.

FIG. 3 illustrates the interior structure of an ink jet printing apparatus used in this embodiment. In FIG. 3; the printing head 1 of this embodiment is used for the color printing, and constituted as an assembly of four printing heads corresponding to four colors, for example, of yellow (Y), magenta (M), cyan(C) and black (K), respectively. The printing heads 1Y, 1M, 1C and 1K are coupled to ink tanks 19Y, 19M, 19C and 19K, respectively, so that the inks are fed to the printing head 1.

A carriage (not shown) carrying the printing head 1 and the ink tank 19 is coupled to a rubber belt 24*b* extending between pulleys 28*a* and 28*b*. The rubber belt 24*b* is wrapped around the pulley 28*b* fixed to a motor shaft 27 to be rotated thereby. Also, the motor shaft 27 is made to rotate by a carriage motor 26. By driving the carriage motor 26, the motor shaft 27 and the pulley 28*b* rotate to move the rubber belt 24*b*, whereby the carriage is made to reciprocate along a guide rail 24*a* in the directions indicated by arrows Sa and Sb (the serial Scan).

The printing by the printing head 1 onto a printing medium 50 is carried out during this serial scan. To maintain the accuracy of the printing position, a sensor attached to the carriage reads an encoder 24*c* extending in the scanning direction, and the ejection timing is adjusted based on the read value.

On the other hand, a conveyor roller 23 is driven by a sheet-feeding motor (not shown) to convey the printing medium 50 of a continuous sheet form or a cut sheet form in the direction orthogonal to the serial scanning direction. After the printing medium 50 is fed into the printing apparatus to reach a position at which the printing operation by the printing head 1 can be carried out, the rotation of the conveyor roller is controlled at a high accuracy so that the sheet can be accurately fed at every printing scan. Further, an additional conveyor roller such as a spur or a runner is provided between the printing head 1 and a platen not shown so that the printing medium 50 is maintained in a stable state during the printing.

When the printing is not carried out, the printing heads 1Y, 1M, 1C and 1K are capped with caps 31Y, 31M, 31C and 31K, respectively, so that the dry-up of ink in the unused printing heads 1 and/or the solidification of viscous ink are avoided. The up-down movement of the cap 31 indicated by an arrow m is controlled by a capping motor not shown.

The cap 31 is also used when the recovery operation is carried out. During the recovery operation of the printing head 1, a recovery pump 30 is driven after the printing head 1 is capped. Then, a negative pressure generates in the vicinity of the orifices of the printing head 1 via the airtight cap 31, and the ink in the vicinity of the orifices flows outside. Thereby, the viscous ink, bubbles blocking ejection or dust in the vicinity of the orifices is discharged from the printing head 1. The flowing-out ink is received by the airtight caps 31 and collected in a waste ink tank (not shown) through pipes 32. In this regard, the recovery pump 30 may be in any types, provided it is capable of positively feed the waste ink to the waste ink tank and sucking the ink in the head by a negative pressure, such as a gear pump, a tube pump, a turbine, a rotor, a piston or a bellows.

After the completion of the sucking operation by the recovery pump, the adhesion of ink is often observed in the vicinity of the orifices of the printing head 1. Accordingly, in general, subsequently to the above-mentioned sucking operation, a so-called wiping operation is carried out, for wiping a surface of the printing head 1 of the respective color. In the printing apparatus of this embodiment, there are a first cleaning member 41 provided with four wiper blades 41B capable of individually cleaning the printing heads 1 of the respective colors and a second cleaning member 42 for further removing the ink adhered to the first cleaning member 41. The first cleaning member 41 removes the ink adhered to the surface of the orifice by moving along a lower part of the printing head 1 in the direction indicated by an arrow L. Then, the first cleaning member 41 is brought into contact with the second cleaning member 42 by the L-directional movement of the first cleaning member 41 and cleaned by the latter member. Thus, the cleaning effect of the printing head 1 is maintained.

A method for forming the image by using the above ink jet printing apparatus will be explained below.

Figure 4:
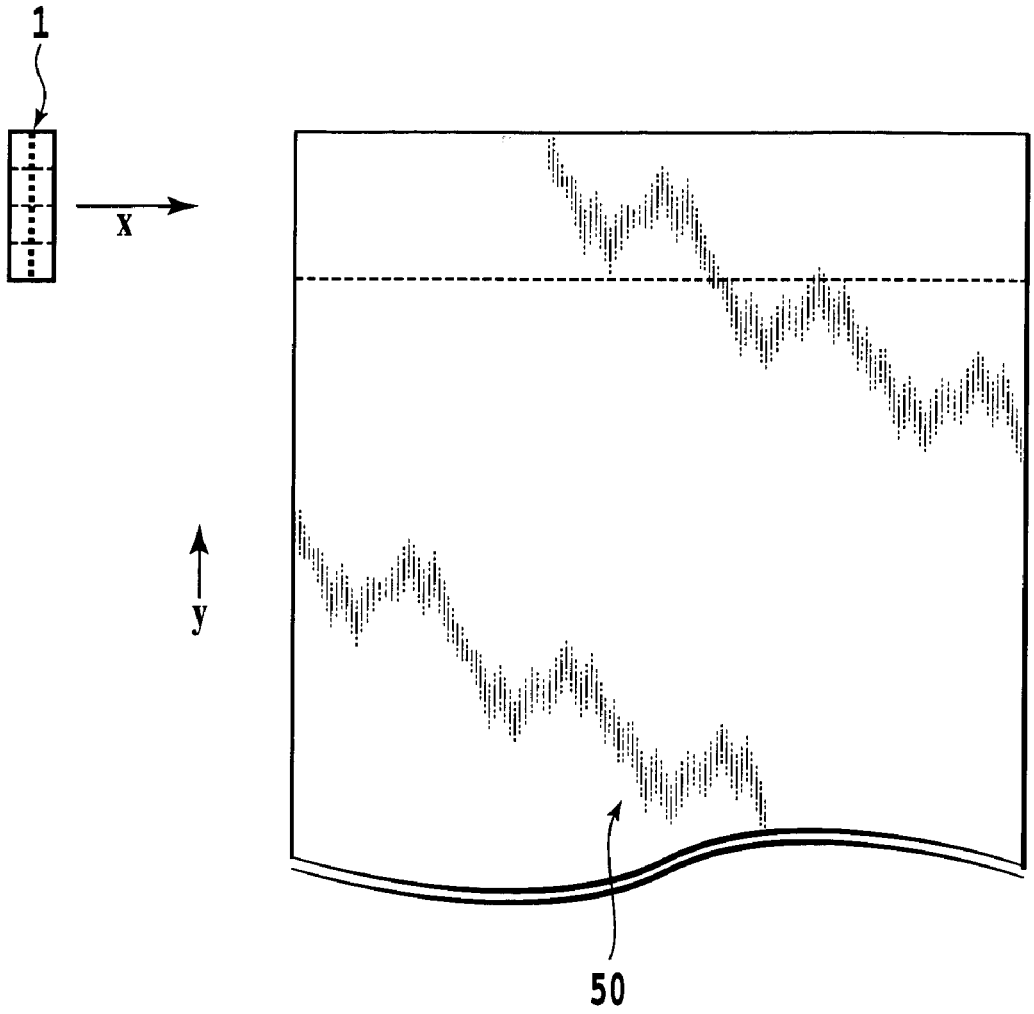
FIG. 4 is a schematic view for explaining the relationship between a printing medium and a printing head when an image is being formed by the serial

FIG. 4 is an illustration for explaining the relationship between the printing medium and the printing head when the image is being formed by the serial type printing apparatus according to this embodiment. In this drawing, the printing head 1 moves in the x-direction while ejecting ink to the printing medium 50. When one printing scan has finished, the printing medium 50 is conveyed in the y-direction by a predetermined distance. By alternately repeating the x-directional printing scan and the y-directional sub-scan, the image is sequentially formed on the printing medium 50.

Figure 5:
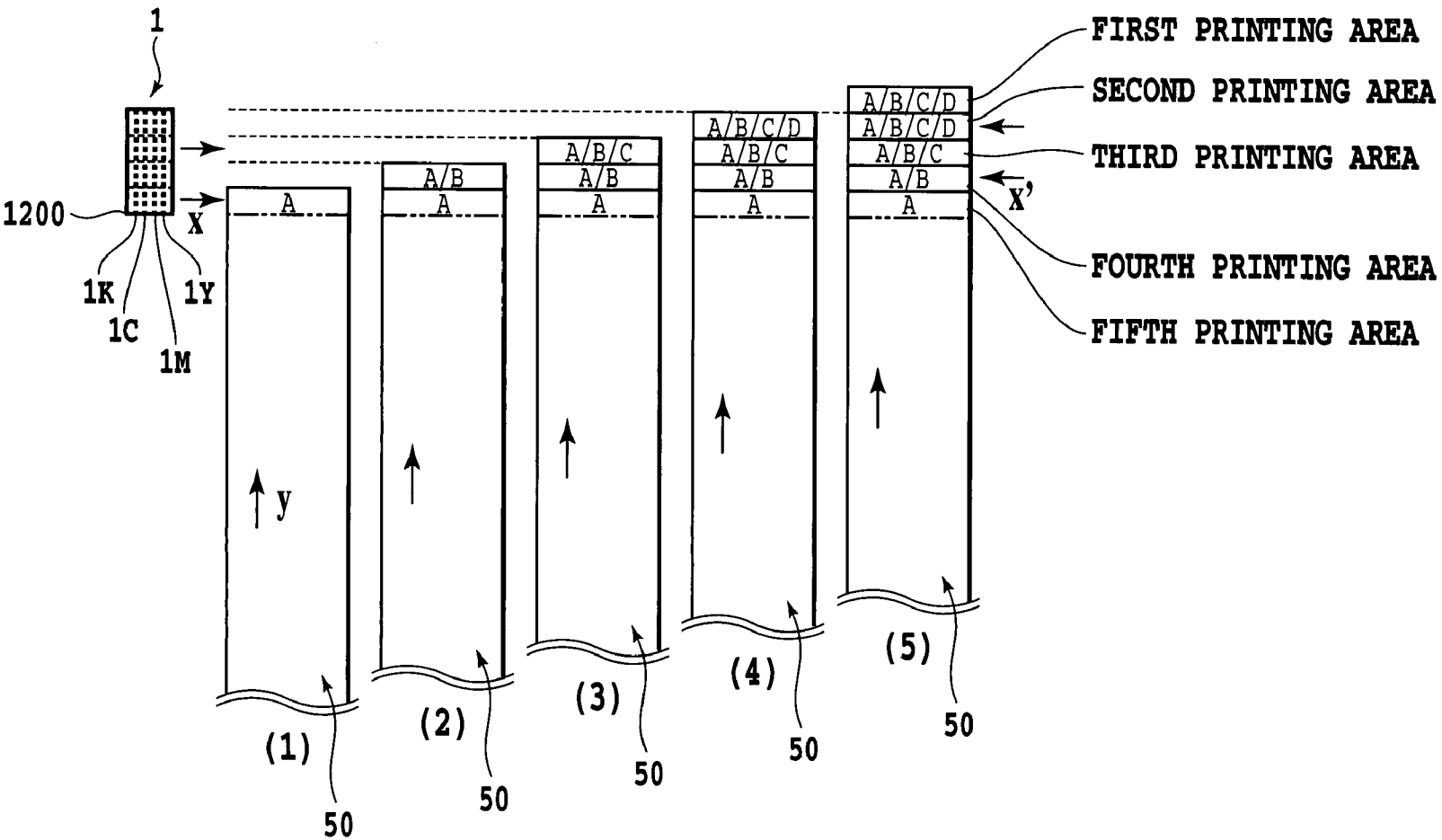
FIG. 5 is a schematic view for illustrating the steps for forming the image by the multi-scan system.

FIG. 5 is a schematic view illustrating the steps for forming the image by the multi-scan system according to this embodiment. The printing head 1 used in this embodiment is constructed by the combination of printing heads for the respective colors of yellow, magenta, cyan and black arranged in this order from the right side, which carries out the printing operation while reciprocating leftward and rightward in the drawing. Accordingly, during the printing scan in the going passage moving from left to right (in the X direction), inks are printed in the order of yellow, magenta, cyan and black On the other hand, during the printing scan in the returning passage moving from right to left (in the X direction), the inks are printed in the reverse order of black, cyan, magenta and yellow.

(1) to (5) illustrate results of the first to fifth printing scans, respectively. The steps for forming the image in the respective areas on the printing medium by the respective blocks of the printing head and the relative positional relationship between the printing head 1 and the printing medium 50 are illustrated.

The four passes multi-scan system is used in this embodiment. A plurality of printing elements arranged on the printing head 1 are divided into four blocks as seen in the sub-scanning direction so that the images in the respective recording area are respectively formed in the different printing blocks during the four printing scans. In this embodiment, the respective four blocks formed by evenly dividing the plurality of printing elements are referred in this embodiment to as A, B, C and D as seen in the downward direction of the drawing (from the upstream side of the conveying direction).

In the first printing scan, the printing medium 50 is conveyed to a position (1) in the drawing relative to the printing head 1. In this state, the X-directional printing is carried out, wherein the actual printing operation is carried out solely by the block A among the four blocks. In FIG. 5, the first printing area in which the printing operation is carried out by the block A is indicated as "A".

Subsequently, the printing medium 50 is conveyed in the Y-direction by a distance corresponding to one block, whereby the relationship between the printing medium 50 and the printing head 1 is as shown in (2).

Since the printing head 1 has already moved rightward during the first printing scan, the printing operation is carried out by the second printing scan in the returning passage in the X'direction. At this time, the first printing area in which the printing has been finished by the first printing scan of the block A is printed by the block B, which is represented as A/B. In the second printing area, the printing operation by the block A is newly carried out. (2) in the drawing illustrates the image-print at an instant when the second printing scan has finished.

Sequentially, the printing medium 50 is conveyed again in the Y-direction by a distance corresponding to one block to a position (3) in the drawing.

As a result of repeating the above steps, a state of the image is as shown in (5). At this stage, the printing by all the blocks A/B/C/D has been completed in the first and second printing areas, while A/B/C in the subsequent third printing area, and A/B in the fourth printing area. In the respective printing area, the image is being completed by one block in every printing scan. Also, in the respective printing area, the printing operation is always carried out in the order of A→B→C→D. According to this embodiment, as described above, by alternately repeating the printing scan for moving the printing head in the predetermined direction (the X direction or the X'direction) while ejecting ink of the plurality of colors from the printing head toward the printing medium and the conveying operation for conveying the printing medium in the direction different form the printing scanning direction (the Y direction), the image is completed during a plurality of printing scans of the printing head (for example, four times) relative to the same area (each of the first to fifth printing areas) on the printing medium.

Figure 6:
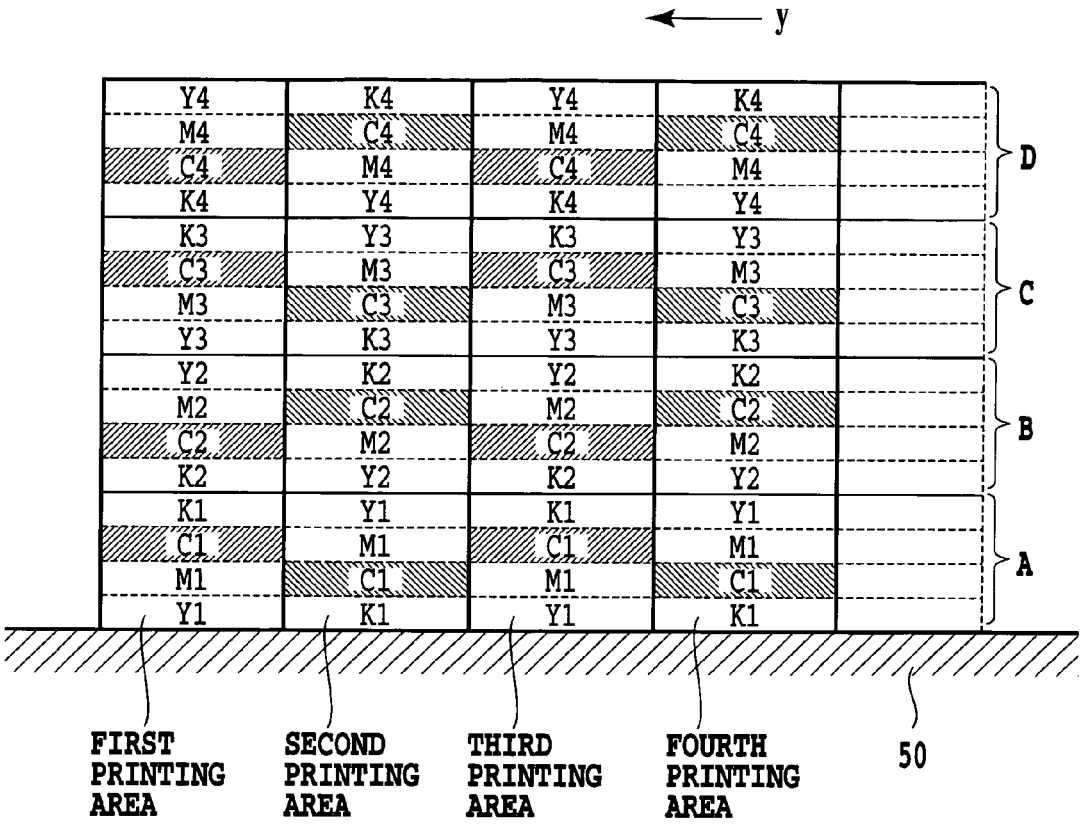
FIG. 6 is a schematic view for illustrating the overlaying of ink colors on the printing medium when the multi-scanning is carried out.

FIG. 6 is a schematic view for explaining the overlaying of ink colors on the printing medium when the printing operation is carried out in accordance with the multi-scan system described with reference to FIG. 5. In FIG. 6, y indicates the conveying direction of the printing medium 50. Each of the first to fourth printing areas is the same as that shown in FIG. 5, and the vertical direction in the drawing illustrates the order of inks-overlaying in the respective printing area.

For example, in the first printing area, since the printing operation is carried out in the going direction by the block A during the first printing scan, the order of ink-overlaying is Y (yellow)→M (magenta)→C (cyan)→K (black). According to this embodiment, since the overlay type ink is used, inks are overlaid with each other in the order of Y, M, C and K from the lowermost layer in the first printing area of the paper surface.

Since the printing operation is carried out by the block B in the returning direction in the succeeding second printing scan, the order of ink-overlaying is K→C→M→Y. Thus, at this time, the inks are overlaid in the order of K→C→M→Y on the black ink located in the uppermost layer in the first printing scan.

As a result of repeating such printing scans until is the fourth printing scan has finished, the overlaying order shown in FIG. 6 is obtained, wherein the ink Y finally printed in the fourth printing scan is located in the uppermost layer in the first printing area. Accordingly, the dominant color in the first printing area is yellow. In the second printing area adjacent thereto, a first printing scan (the second printing scan in FIG. 5) by the block A is carried out in the returning direction. Accordingly, the lowermost layer on the printing medium 50 is black. Further, the final printing scan is carried out in the going direction, and thus the uppermost layer representing the dominant color is black.

It is apparent by the comparison of the first printing area with the second printing area that four printing scans are repeated in the respective area in the direction in reverse to each other. Accordingly, the overlaying order of inks is reversed between both the areas so that the dominant color is yellow and black in the respective areas. In the odd-numbered printing area subsequent to the third printing area, the printing operation is carried out in the same order as in the first printing area. Thus, the dominant color is yellow. In the even-numbered printing area subsequent to the fourth printing area, the printing operation is carried out in the same order as in the second printing area. Thus, the dominant color is black.

When the printing operation by the multi-scan system is bi-directionally carried out, the dominant color changes between every adjacent printing areas. If the color difference between the respective areas becomes significant to be visually recognizable, the color-banding appears. Since the description has already been made about the color-banding including the solution thereof, the detailed explanation will be eliminated here. In the present invention, the description will be made how the glossy-banding caused by the difference in dominant color as shown in FIG. 6 is reduced as much as possible.

In general, the glossy-banding is derived from a characteristic property of used ink. In this embodiment, an aqueous pigment having a colorant concentration in a range from approximately 3 to 5% and a specific weight in a range from approximately 1.05 to 1.07 is used for either one of four color inks. The degree of glossiness relative to the ink-ejection amount of the respective ink is as shown in FIG. 1. Particularly, cyan is characterized by the visually reddish bronzing.

Generally, color images are almost formed of the mixture of three colors; yellow, magenta and cyan; and black is often used alone. Since black ink is liable to be sensed as rich in particulate feeling, the image data are often prepared to reduce black as much as possible in the color image. Thereby, black ink is hardly disposed as the uppermost layer above other color ink, and in this embodiment, cyan rich in glossiness and bronzing likely to be the dominant color in the even-numbered printing area. This is because in the even-numbered printing area, cyan is disposed in the uppermost layer when black is not printed.

In the even-numbered printing area in which cyan is disposed in the uppermost layer, the image has a relatively high degree of glossiness, and in the odd-numbered printing area in which yellow is disposed in the uppermost layer, the image has a relatively low degree of glossiness. That is, when on objective is printed, the area having a high degree of glossiness alternates with that having a low degree of glossiness although they have the same color tint.

By the way, when the printing of the multi-scan system is established as described with reference to FIG. 5, any mask patterns may be used, provided the complemental relationship is maintained between patterns printed by the four blocks. Also, it is possible to freely select a method of the pattern arrangement and to make the deviation in the printing percentage in the respective block. Accordingly, the present inventors have diligently studied to result in some characteristic mask patterns capable of avoiding the glossy-banding. The preferred examples of such mask patterns will be described below.

EXAMPLE 1

Example 1 of the present invention will be explained.

Figure 7A:
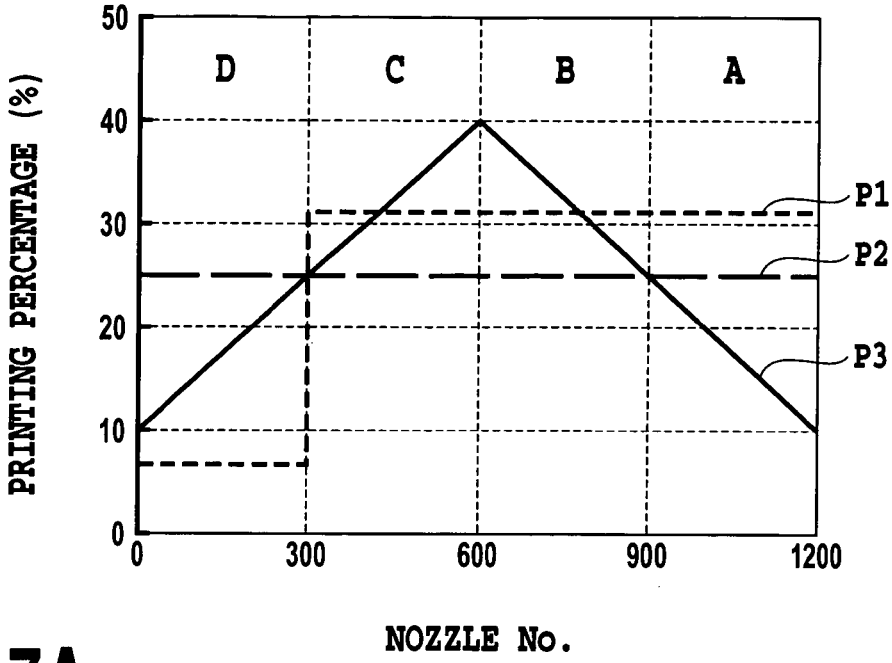
FIGS. 7A and 7B are schematic views for illustrating the printing percentages of the respective nozzles (the respective blocks) in the mask used in the inventive embodiment and the mask patterns thereof, respectively.
Figure 7B:
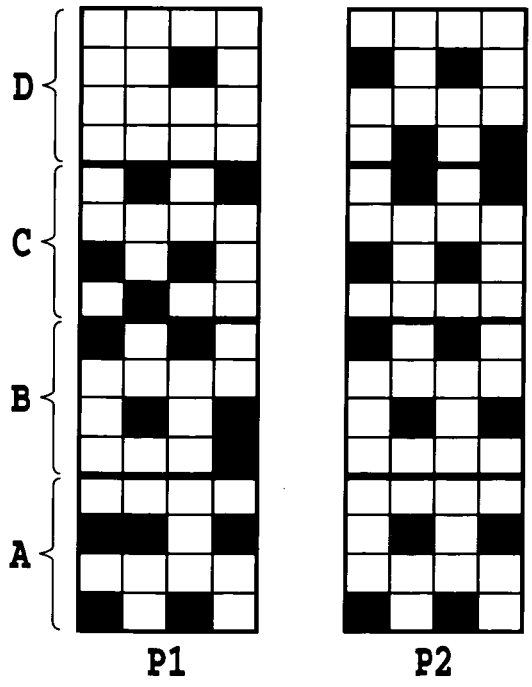

FIG. 7A is a schematic view for illustrating the printing percentages of the respective nozzles (the respective blocks) in the mask used in this example, and FIG. 7B is a schematic view for illustrating the mask patterns thereof. In FIG. 7A, an abscissa axis represents nozzles arranged on the printing head, numbered from 1 to 1200 as seen from downstream in the conveying direction of the printing medium. A, B, C and D represent blocks in which nozzles Nos. 1 to 300 belong to the block D; those Nos. 301 to 600 belong to the block C; those Nos. 601 to 900 belong to the block B; and those Nos. 901 to 1200 belong to the block A.

An ordinate axis represents the printing percentage of the mask pattern relative to the respective nozzle. Since a four-passes multi-scan is carried out in this case, the printing percentage is 25% in all the blocks as in a mask P2, unless any deviation of the printing percentage is made between blocks or nozzles.

In this Example, a mask pattern represented by P2 is used for inks having a relatively low degree of glossiness (black, magenta and yellow). On the other hand, a mask pattern having a characteristic of P1 in which the printing percentage is low solely in the block D in comparison with other blocks is used for cyan having a high degree of glossiness. Such a structure of the mask pattern is effective for the reduction of probability in that cyan becomes the dominant color. That is, data of cyan is almost printed by initial three printing scans carried out by the block A to C, and difficult to be printed by the final printing scan. Accordingly, ink other than cyan is disposed in the uppermost layer by this final printing scan and becomes the dominant color.

The masks P1 and P2 in FIG. 7B are examples of the mask pattern for an area having 4 nozzles in the vertical direction and 4 pixels in the horizontal direction. In practice, this pattern is repeated in the vertical and horizontal directions to form one block having 300 nozzles in the vertical direction and a width corresponding to that of the printing area.

In such a manner, according to this example, to reduce the probability in that ink color high in degree of glossiness and liable to generate the bronzing appears in the surface layer, the printing percentage of this ink color in the final printing scan is controlled to be less than that of the other. Thereby, it is possible to suppress the difference in degree of glossiness between the respective printing area and thus reduce the glossy-banding.

The above structure is effective for eliminating the glossy-banding caused by the variation of the printing duty generating during not only the bi-directional printing but also the mono-directional printing. The explanation thereof is as follows.

In general, the color-banding or the glossy-banding generated by the bi-directional multi-scan system is avoidable by changing the multi-scan to the mono-directional printing. In the mono-directional printing, since the dominant color is identical in the respective printing area even if the printing operation is carried out either in the going path or in the returning path, no difference appears in color or degree of glossiness between the respective printing areas due to the order of the ink-ejection. However, as a result of the diligent study of the present inventors using inks having characteristics shown in FIG. 1, the difference in degree of glossiness has been detected between the printing areas, which is different from the above-mentioned glossy-banding. And, it has been found that this new glossy-banding is somewhat different between a case wherein the printing operation is always carried out in the going path so that the dominant color is cyan and another case wherein the printing operation is always carried out in the returning path so that the dominant color is yellow.

Concretely, it has been found that the difference in glossiness is easily sensible in the image having a variable printing duty, when an ink, the degree of glossiness of which largely varies relative to the ink-ejection amount, such as cyan ink as shown in FIG. 1, is unified as a dominant color. Contrarily, it has been found that the difference in glossiness is not sensible even in the image having a variable printing duty, when an ink, the degree of glossiness of which is low and stable relative to the ink-election amount, such as yellow ink is unified as a dominant color. That is, when a plurality of color inks different in variation of glossiness with respect to the variation of the ink-ejection amount per unit area as shown in FIG. 1 are used for the printing operation, it is preferable that a color having a relatively small variation in glossiness (yellow) becomes a dominant color. To select a color having a relatively small variation in the glossiness (yellow) as a dominant color, the printing percentage of the color having a relatively small variation in glossiness (yellow) may be made higher than that of the color having a relatively large variation in glossiness (cyan) during the final scan in a plurality of scans in the same area. One of favorable means for realizing such an idea is the use of masks shown in FIGS. 7A and 7B. Thus, it is possible to select yellow as a dominant color in all the areas According to this example, it is possible to reduce the glossy-banding caused by the printing duty even if the printing operation is carried out either in the bi-directional manner or in the mono-directional manner.

As described above, according to this example, in the ink jet printing apparatus using pigment inks having characteristics of the degree of glossiness shown in FIG. 1, in the final printing scan the printing duty of cyan ink which degree of glossiness largely varies with respect to the printing duty is set to be lower than the other inks. Thereby, it is possible to reduce the glossy-banding in the respective printing areas when the bi-directional printing is carried out and the glossy-banding generated due to the printing duty.

SECOND EXAMPLE

A second example of the present invention will be described below. Also in this example, the same printing apparatus and inks are used as in Example 1. Regarding cyan ink, however, a mask pattern P3 shown in FIG. 7A is used in this example. While a mask pattern P2 by which all nozzles have the printing percentage of 25% is used for the other three color inks, as the same manner as in Example 1.

In the mask pattern P3, the printing percentage is set as high as 40% in a central region of the printing head, which gradually lowers to the end region, and finally reaches 10% in the endmost region.

The lowering of the printing duty in the end region in such a manner is effective for concealing the joint streak appearing in the boundary between the respective printing areas as disclosed in the patent document cited in the prior art. In addition, if the mask pattern having such a smooth gradation as a whole is used, there is no such an extreme difference in printing percentage between blocks D and C as in the mask pattern P1 used in Example 1. Accordingly, it is expected to have a smoother state in the printed image. Of course, since the printing percentage of the cyan ink in the final printing scan is lower than those of the other inks, the same effect for reducing the glossy-banding is obtainable as in Example 1.

As described above, according to this example, in the ink jet printing apparatus using pigment inks having the degree of glossiness shown in FIG. 1, a mask of such a gradation as having a peak value of the printing percentage at a center of nozzle rows is used for the cyan ink higher in degree of glossiness and larger in variation of degree of glossiness with respect to the printing duty than the other color inks. Thereby, it is possible to reduce the glossy-banding in the respective printing area when the bi-directional printing is carried out, and reduce the glossy-banding generated due to the printing duty, while reducing the joint streak in every printing scan of the cyan ink.

THIRD EXAMPLE

A third example of the present invention will be described below. Also, in this example, the same printing apparatus and inks as in the above-mentioned example are used. However, according to this example, it is designed to extend the effect of the mask P3 used in the second example; i.e., the reduction of joint streak; to the other ink colors.

As already described in Example 2, the triangular mask pattern as P3 is capable of simultaneously reducing the joint streak and the glossy-banding appearing in every printing scan. Because the printing percentage at opposite ends is low. However, if such a mask as having high printing percentage in a central area is commonly adopted to every colors, in an area to be printed by a central block, there may be risk in that an image drawback such as beading occurs because a time for the printing medium to absorb the ink becomes insufficient. Particularly, when the overlay type ink is used as in this embodiment, this phenomenon is significant, and there may be a risk in that the glossy-banding becomes rather conspicuous in the area of the printed by the central of the printing head due to the aggregation of color inks caused by the beading. Accordingly, in this embodiment, while the triangular mask capable of reducing the joint streak in the respective color ink is used, it is also designed to shift positions from each other, at which the printing percentage becomes a peak.

Figure 8:
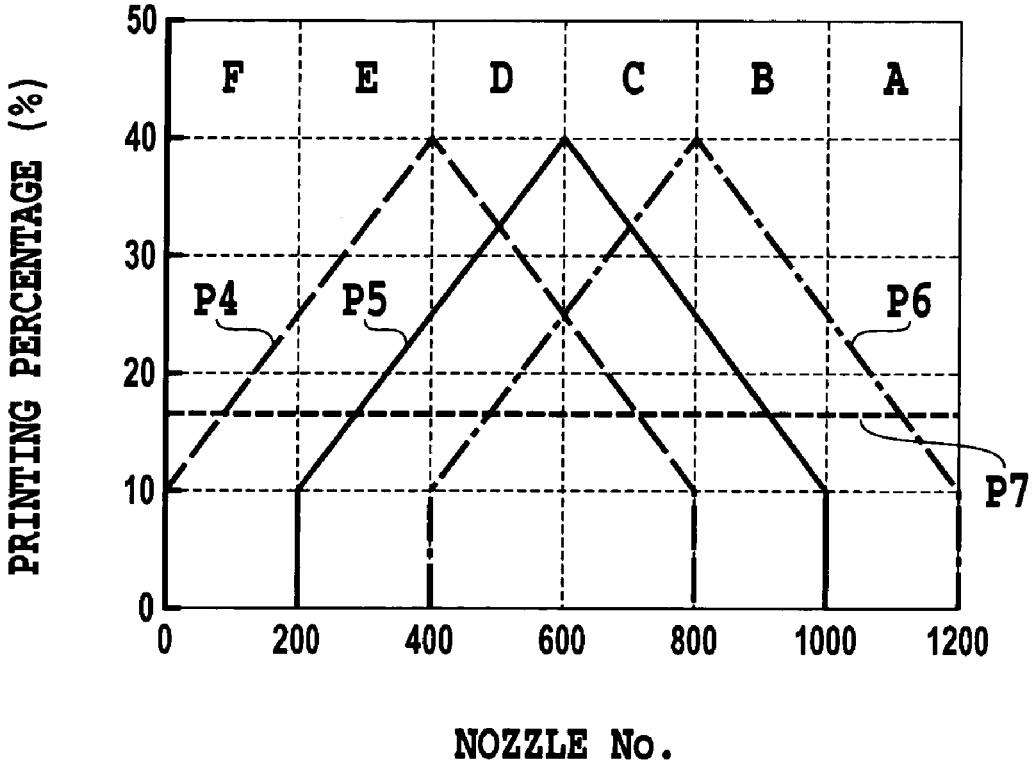
FIG. 8 illustrates the printing percentages of the respective nozzles (the respective blocks) in the mask pattern used in a third embodiment of the present invention.

FIG. 8 illustrates the printing percentages of the mask patterns for the respective nozzles (the respective blocks)

used in this example. In this example, the printing elements for the respective colors are divided into six blocks A to F, wherein block F contains nozzles Nos. 1 to 200, block E contains nozzles Nos. 201 to 400; block D contains nozzles Nos. 401 to 600; block C contains nozzles Nos 601 to 800; block B contains nozzles Nos. 801 to 1000; and block A contains nozzles Nos. 1001 to 1200.

The printing operation is carried out by the printing head of the respective color while using four blocks in the above six blocks. For examples in the printing head using the mask pattern P4, blocks A and B are not used, but the printing operation is carried out by blocks C to F at the printing percentages shown in the drawing. A peak of the printing percentage is 40% at a point between blocks D and E. In the mask pattern P5, the printing operation is carried out by using blocks B to E. A graph of the printing percentage in the respective block is similar to that of P4, and a peak of the printing percentage is 40% at a point between blocks C and D In the mask pattern P6, the printing operation is carried out by using blocks A to D, and a peak of the printing percentage is at a point between blocks B and C. Further, in this example, a mask pattern P7 having a constant printing percentage is prepared. In the mask pattern P7, the printing percentage is 100/6≈16.7% in all the blocks.

In this example, the mask P6 is used for cyan ink which is most liable to generate the bronzing. When the mask P6 is used, since the printing operation completes by four printing scans from the beginning and other inks are printed by residual two scans, cyan is difficult to be the dominant color. The mask P5 is used for magenta ink which is liable to generate the bronzing next to cyan ink, and the mask P4 is used for yellow ink which is least liable to generate the bronzing. Further, the mask P7 having the same printing percentage in all blocks is used for black ink basically hardly printed while mixed with other colors.

As described above, by shifting peaks of the printing percentage of three colors to each other, it is possible to avoid that the printing percentages of all the colors reach the peak values to the same area, and to widely disperse the total printing percentage to all the printing areas. Accordingly, it is possible to prevent the bronzing due to the ink aggregation described above to some extent. By carrying out the printing operation in the order of the degree of ink glossiness, it is possible to determine the dominant color on the printing medium as a color difficult to generate the bronzing, whereby the same effect as in the preceding examples. Further, since the position of the nozzle used for the printing is different in every color, it is possible to shift the joint between every colors on the printing medium, whereby the effect for avoiding the generation of joint streak is more positively expectable.

According to this embodiment, as described above, by shifting positions of peak values from each other in the suitable order of ink colors while using gradation mask having a peak value at a predetermined position, it is possible simultaneously to prevent the joint streak and to avoid the glossy-banding.

FOURTH EXAMPLE

A fourth example will be described below. Also in this embodiment, the same printing apparatus and inks as in the above-mentioned example are used. However, according to this example, nozzles of a printing head is divided into three blocks and an image is completed by three multi-scan systems.

Figure 9:
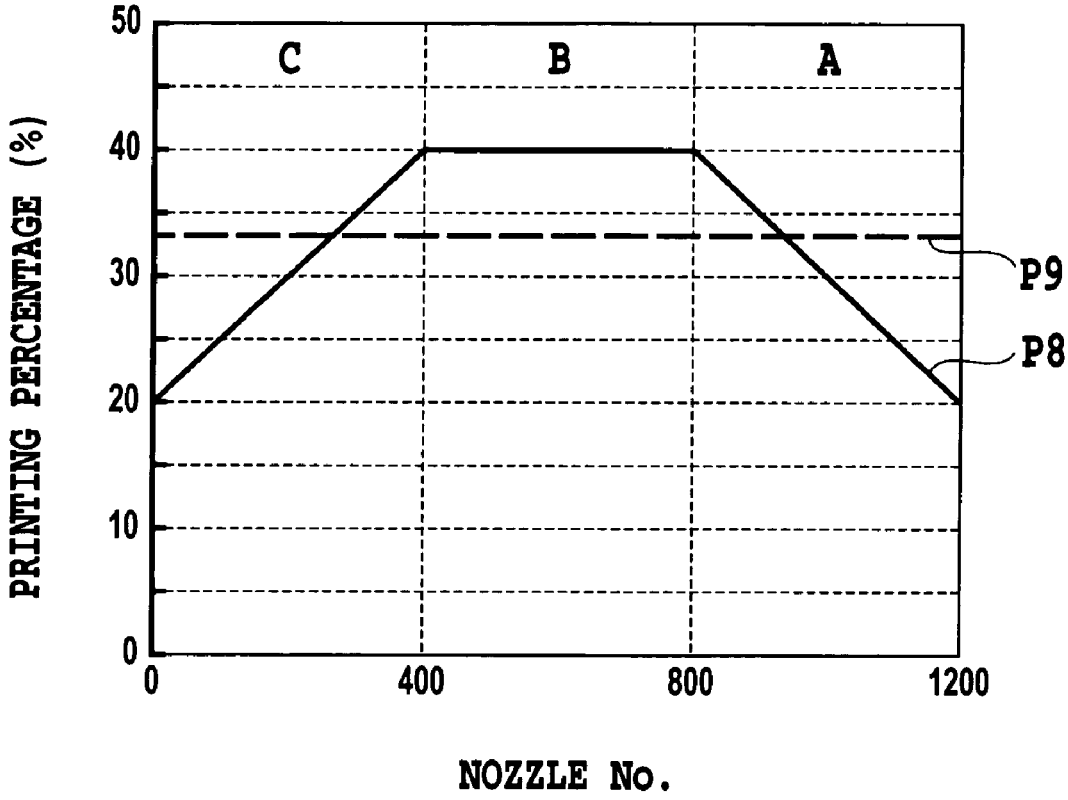
FIG. 9 illustrates the printing percentages of the respective nozzles (the respective blocks) in the mask pattern used in a fourth embodiment of the present invention.

FIG. 9 illustrates the printing percentages of a mask pattern in the respective nozzle (block) used in this example. According to this example, nozzles for the respective color is divided into three blocks A to C, where in block C contains nozzles Nos. 1 to 400; block B contains nozzles Nos. 401 to 800; and block A contains nozzles Nos. 801 to 1200.

According to this example, irrespective of printing duty, a mask pattern P9 having a uniform printing percentage of 33% is used for a yellow ink having the lowest degree of glossiness irrespective of the ink-ejection amount, and a black ink often printed as a mono-color. On the other hand, a trapezoidal mask P8 is used for a cyan ink and a magenta ink having a relatively high degree of glossiness. In this mask pattern P8, the printing percentage is uniformly 40% in the central block B and has no peak value of the printing percentage unlike to the second and third examples. By doing so, even in the multi-scan printing of less number of passes, the local aggregation of ink is avoidable because the peak value does not exceeds 40% while the same effect is obtained as in the above-mentioned gradation mask.

As described above, according to this example, it is possible to prevent the glossy-banding even in the relatively less multi-scan systems by using a trapezoidal mask having no peak value at a predetermined position for ink having a relatively high degree of glossiness.

In this regard, according to the above-mentioned second, third and fourth examples, mask patterns in which the printing percentages along the nozzle-arrangement direction are changed in a triangular or trapezoidal shape having a peak value as an apex are used. However, the effect of the present invention and the respective example should not be limited thereto. For example, a mask pattern in which the printing percentage varies in a reverse U-shape may be used.

OTHERS

As shown in FIG. 6, in the above examples, the overlay type ink was used so that the later-ejected ink locates in an upper layer (surface layer) and overlays the earlier-ejected ink. However, even in the overlay type ink, the later-ejected ink may not always locate in the upper layer (surface layer). While the later-ejected ink locates in the upper layer in most areas, part thereof may be in the lower layer. The present invention does not exclude such a case. If most of the later-ejected ink locates in the upper layer (surface layer), the present invention may be applicable, even though part of the later-ejected ink does not locate in the upper layer (surface layer). That is, the present invention is applicable when a ratio of the ink surface layer formed by the later-printed ink is larger than that of the ink surface layer formed by the earlier-printed ink in a case wherein the later-printed ink overlays the earlier-printed ink in the printing medium. One example of such an ink is preferably a pigment type ink.

In the respective example of the present invention, the ink color having a particularly high degree of glossiness is featured, and a mask pattern having a characteristic different from that for the other ink color is used solely for this ink color. That is, the relative comparison of a parameter called as the degree of glossiness between the respective inks is carried out to select the ink color particularly problematic in the image formation, and a mask pattern apparently differentiated from the other colors is used therefore. Contrarily, in the countermeasure for preventing the color-banding, the end deflection or the joint streak, since these phenomena do not occur due to a particular ink color, approximately similar mask patterns are devised and disclosed for all ink colors. Accordingly, an object thereof as well as a derived pattern structure and a resultant effect are apparently different from those of the present invention.

For example, even if a technical idea of Japanese Patent No. 3,200,143 dicloses that a mask pattern is changed in accordance with colors is combined with a technical idea of Japanese Patent Application Laid-open No. 2002-144552 disclosing that a mask pattern is used so that the cover amount in first two passes are equal to each other, it is impossible to reduce the bronzing of the overlay type ink. This combination solely suggests that the dominant color is equalized in the printed image. Accordingly, even if such an equalizing operation is carried out, the glossy-banding caused by the concentration variation of the image may appear when colors high in degree of glossiness are more visible.

The degree of glossiness is different in concept from color, and thought to be variable in accordance with the ink composition. The present inventors look at the degree of glossiness, not color, and for the purpose of controlling the dominant color on the printing medium, try so that the color low in degree of glossiness becomes the dominant color by using a mask pattern. Accordingly, the technical idea of the present invention is never achievable by a mere combination of the above patent documents.

Also, in the above description, the control is made so that the ink color high in degree of glossiness is not the dominant color. This is the same as that the glossiness-erasing effect of the ink low in degree of glossiness is used. That is, irrespective of the degree of glossiness of other inks, if the ink or mere liquid having the glossiness-erasing effect which is low and stable in degree of glossiness irrespective of the ink-ejection amounts is printed finder the condition in that this ink becomes the dominant color, the drawback caused by the glossiness of the whole image is eliminated. In the above example, as one of such means, a mask pattern is used in the multi-scan printing operation.

Accordingly, there may be various methods for achieving the object and effect of the present invention. For example, in the serial type ink jet printing apparatus shown in FIG. 3, if the mono-directional scan is carried out always from left to right while the printing heads are arranged in the order in the scanning direction, the ink finally landed on the printing medium is yellow high in glossiness-erasing effect in either of printing scans. If the order of the printing heads changes to yellow, magenta, cyan, magenta and yellow, it is possible to make yellow as the dominant color even by the bi-directional printing. Furthermore, a colorless transparent liquid may be prepared separately from the respective inks for the purpose of erasing the glossiness, and printed at a final stage all over the image or a portion in which the glossiness is liable to generate at a final stage, resulting in the above-mentioned effect. The present invention achieves the object based on such a technical idea while using a mask pattern in the serial type multi-scan system Also in view of this point, the present invention is apparently different from the prior art.

While four inks of Y, M, C and K are used for the purpose of simplicity in the above-mentioned examples, the present invention should not be limited thereto. Recently, more kinds of inks, for example, six or seven kinds, prepared by mixing a plurality of inks of the same color tone but different in concentration may be used for the printing since the gradation becomes important. In FIG. 1, the glossiness characteristics of pale cyan (Lc) and pale magenta (Lm) are shown as a reference. Also, a method for forming a monochromic black image is proposed by using a plurality of black inks having dark, medium and pale colors, in which the gradation is important. Further, a special color such as a skin color may be preliminarily prepared or secondary colors such as red, green or blue may be independently prepared. In either case, if the characteristic of glossiness relative to the ink-ejection amount of the respective ink is investigated and a mask pattern is set so that the printing by an ink color having a large amount of variation in the glossiness in accordance with the ink-ejection amount is completed at a relatively early stage of the printing scan, the present invention is effective, Particularly, when a plurality of inks of the same color but different in concentration are used, it is effective for reducing the glossy-banding in a medium concentration area in which a deep ink and a pale ink are overlaid with each other that a mask pattern is designed so that an ink having a high ratio of colorant completes the printing in an earlier printing scan than other ink having the low ratio.

While the overlay type ink using pigment as a colorant is explained hereinabove, the present invention should not be limited thereto. For example, when a permeable type ink using dyestuff as a colorant is used, the overlaying order of the respective areas described with reference to FIG. 6 is reversed. When the permeable type ink is used, a first printed ink becomes the dominant color and a subsequently printed ink permeates through the preceding ink layer and reaches the underside thereof.

Therefore, when the present invention is applied while using such an ink, a mask pattern is structured so that an ink having a risk due to the glossiness is not printed in the first printing scan, unlike a case of the overlay type ink. By doing so, the ink difficult to occur the bronzing becomes the dominant color, and the ink having a risk of bronzing permeates underside.

Briefly, in either of the overlay type ink or the permeable type ink, in the important printing scan among a plurality of printing scans in which the dominant color is set, the printing percentage of an ink relatively low in glossiness is selected higher than the printing percentage of other ink relatively high in glossiness. Thus, the present invention is effective. As described before, however, since the bronzing is liable to occur in the overlay type ink, the effect of the present invention is significant when the overlay type ink is used.

While the description has been made as the mask patterns in the respective blocks are in the complemental relationship with each other in the above examples, the mask patterns should not be limited to those having the 100% complemental relationship. For example, the present invention has the same effect as in the above-mentioned examples when six blocks are printed by the printing percentage of 25%, respectively, so that the final image has the printing percentage of 150%.

Furthermore, while the ink jet printing head has an electro-thermal converter as shown in FIG. 2 in the above examples, the present invention should not be limited thereto. Since the printing elements could be arranged at a relatively higher density in such a printing head than in the other systems, a high-precision image is realized at a high performance in the present invention. However, the present invention is also effective when an electro-pressure converter of a piezoelectric element type is provided in the printing element so that ink is ejected by this pressure.

Moreover, the ink jet printing apparatus of the present invention may be of a type used as an image-output terminal of an information processor such as a computer or a copier combined with a reader or a facsimile device having a transmission function.

As described above, according to the present invention, since the ink relatively low in degree of glossiness is liable to be a dominant color, while the ink relatively high in degree of glossiness is difficult to be a dominant color, the image is stabilized at a low degree of glossiness, whereby the generation of glossy-banding is avoidable even if the bi-directional printing is carried out or the printing duty varies.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. A method for printing an image on a printing medium by ejecting ink from a plurality of printing heads for ejecting different inks, the method comprising the steps of:

scanning the printing heads with respect to the printing medium in a predetermined direction while printing the image on the printing medium, the scan being repeated a plurality of times for the same area of the printing medium to complete the image; and effecting relative movement between the printing medium and the printing heads in a direction different from the predetermined direction between the scans, wherein a printing percentage of one ink having a relatively low degree of glossiness is higher than that of other inks having a relatively high degree of glossiness in one of the plurality of scans in which a dominant color on the surface of the printing medium is defined.

2. A method as defined by claim 1, wherein the inks have a characteristic that a later printed ink is more dominant on the surface of the printing medium than an earlier printed ink and, in a last scan of the plurality of scans, the printing percentage of the ink having a relatively low degree of glossiness is set to be higher than that of the inks having a relatively high degree of glossiness.

3. A method as defined by claim 2, wherein the respective inks contain pigment.

4. A method as defined by claim 1, wherein the inks have a characteristic that an earlier printed ink is more dominant on the surface of the printing medium than a later printed ink and, in a first scan of the plurality of scans, the printing percentage of the ink having a relatively low degree of glossiness is set to be higher than that of the ink having a relatively high degree of glossiness.

5. A method as defined by claim 1, wherein the inks have a characteristic that a later printed ink is more dominant on the surface of the printing medium than an earlier printed ink and, in a last scan of the plurality of scans, the printing percentage of the ink having a relatively lesser variation of the degree of glossiness with respect to a printing duty is set to be higher than that of the ink having a relatively greater variation of the degree of glossiness with respect to the printing duty.

6. A method as defined by claim 1, wherein the inks have a characteristic that an earlier printed ink is more dominant on the surface of the printing medium than a later printed ink and in a first scan of the plurality of scans, the printing percentage of the ink having a relatively lesser variation of the degree of glossiness with respect to a printing duty is set to be higher than that of the ink having a relatively greater variation of the degree of glossiness with respect to the printing duty.

7. A method as defined by claim 1, wherein the printing scan is carried out in scans in a forward direction and a return direction.

8. A method as defined by claim 1, wherein, in an image area on the printing medium printed by one scan, the printing percentage in an end region corresponding to an end nozzle of each of the print heads is lower than in a central region, and a position of the highest printing percentage of the image area is different for each of the plurality of printing heads.

9. A method for printing an image by carrying out a printing scan in which a plurality of printing heads for ejecting a plurality of pigment inks move in a predetermined direction while ejecting the inks toward a printing medium, and a conveying motion in which the printing medium moves in a direction different from that of the printing scan, the printing scan of the printing heads being repeated a plurality of times for a same area of the printing medium to complete the image, wherein the plurality of pigment inks are different in degree of glossiness from each other when a predetermined amount thereof is applied to a unit area, and in a final printing scan of the plurality of printing scans for the same area, the printing percentage of an ink relatively low in the degree of glossiness is set to be higher than that of an ink relatively high in the degree of glossiness.

10. A method for printing an image by carrying out a printing scan in which a plurality of printing heads for ejecting a plurality of inks move in a predetermined direction while ejecting the inks toward a printing medium, and a conveying motion in which the printing medium moves in a direction different from that of the printing scan, the printing scan of the printing heads being repeated a plurality of times for a same area of the printing medium to complete the image, wherein the plurality of inks are different in degree of glossiness from each other when a predetermined amount thereof is applied to a unit area, and have a nature in that, when an earlier printed ink is overlaid with a later printed ink on the printing medium, a proportion of a surface layer formed by the later printed ink is greater than that of a surface layer formed by the earlier printed ink, and in a final printing scan of the plurality of printing scans for the same area, the printing percentage of an ink relatively low in the degree of glossiness is set to be higher than that of an ink relatively high in the degree of glossiness.

11. A method for printing an image by carrying out a printing scan in which a plurality of printing heads for ejecting a plurality of pigment inks different in a degree of glossiness from each other move in a predetermined direction while ejecting the inks toward a printing medium, and a conveying motion in which the printing medium moves in a direction different from that of the printing scan, the printing scan of the printing heads being repeated a plurality of times for a same area of the printing medium to complete the image, wherein the plurality of pigment inks are different in a variation amount of the degree of glossiness with respect to a variation of ink amount applied to the same area of the printing medium, and in a final printing scan of the plurality of printing scans for the same area, the printing percentage of an ink relatively low in the variation amount of the degree of glossiness is set to be higher than that of an ink relatively high in the variation amount of the degree of glossiness.

12. A method for printing an image by carrying out a printing scan in which a plurality of printing heads for ejecting a plurality of inks move in a predetermined direction while ejecting the inks toward a printing medium alternately with a conveying motion in which the printing medium moves in the direction different from that of the printing scan, the printing scan of the printing heads being repeated a plurality of times for a same area of the printing medium to complete the image, wherein the plurality of inks are different in a variation amount of the degree of glossiness with respect to a variation of the ink-ejection amount in a unit area, and have a nature in that, when an earlier printed ink is overlaid with a later printed ink on the printing medium, a proportion of a surface layer formed by the later printed ink is greater than that of a surface layer formed by the earlier printed ink, and in a final printing scan of the plurality of printing scans in for the same area, the printing percentage of an ink relatively low in the variation amount of the degree of glossiness is set to be higher than that of an ink relatively high in the variation amount of the degree of glossiness.

* * * * *

UNITED STATES PATENT AND TRADEMARK OFFICE

CERTIFICATE OF CORRECTION

PATENT NO. : 7,152,950 B2
APPLICATION NO. : 10/843461
DATED : December 26, 2006
INVENTOR(S) : Takekoshi It is certified that error appears in the above-identified patent and that said Letters Patent is hereby corrected as shown below:

COLUMN 5:
Line 16, "No. 3,200,143," should read --No. 3200143,--.
Line 25, "No. 3,236,034," should read --No. 3236034,--.
Line 52, "No. 3,093,489," should read --No. 3093489--.

COLUMN 6:
Line 58, "No. 3,249,878." should read --No. 3249878.--.

COLUMN 7:
Line 35, "is relied" should read --relies--.
Line 49, "In" should read --in--.

COLUMN 8:
Line 22, "thereto" should read --thereto.--.
Line 34, "3,200,143 or 3,236,034." should read --3200143 or 3236034.--.
Line 55, "3,200,143 or 3,236,034" should read --3200143 or 3236034--.

COLUMN 9:
Line 37, "A" should read --a--.
Line 54, "A" should read --a--.
Line 59, "A" should read --a--.
Line 61, "there from" should read --therefrom--.

COLUMN 10:
Line 8, "forth" should read --fourth--.
Line 9, "A" should read --a--.
Line 11, "there from" should read --therefrom--.
Line 30, "A" should read --a--.
Line 50, "A" should read --a--.

COLUMN 11:
Line 21, "serial" should read --serial scans;--.

COLUMN 13:
Line 15, "feed" should read --feeding--; and "in any types," should read --of any type,--.

UNITED STATES PATENT AND TRADEMARK OFFICE

CERTIFICATE OF CORRECTION

PATENT NO. : 7,152,950 B2
APPLICATION NO. : 10/843461
DATED : December 26, 2006
INVENTOR(S) : Takekoshi It is certified that error appears in the above-identified patent and that said Letters Patent is hereby corrected as shown below:

COLUMN 17:
Line 53, "areas" should read --areas.--.

COLUMN 20:
Line 17, "less" should read --a fewer--.
Line 19, "exceeds" should read --exceed--.
Line 23, "less" should read --fewer--.

COLUMN 21:
Line 4, "3,200,143 discloses" should read --3200143 discloses--.
Line 54, "system" should read --system.--.

COLUMN 24:
Line 2, "scan" should be deleted.

COLUMN 26:
Line 7, "in" (second occurrence) should be deleted.

Signed and Sealed this

Twenty-sixth Day of August, 2008

JON W. DUDAS
*Director of the United States Patent and Trademark Office*